US005535728A

United States Patent [19]

Prodigo

[11] Patent Number: 5,535,728

[45] Date of Patent: Jul. 16, 1996

[54] OVERDRAW ARROW REST DEVICE

[76] Inventor: Anthony A. Prodigo, 332 Judd St., Sierra Vista, Ariz. 85635

[21] Appl. No.: 315,220

[22] Filed: Sep. 29, 1994

[51] Int. Cl.[6] ..... F41B 5/22

[52] U.S. Cl. ..... 124/44.5

[58] Field of Search ..... 124/24.1, 44.5, 124/86, 88

[56] References Cited

U.S. PATENT DOCUMENTS

| | | | |
|---|---|---|---|
| 5,022,378 | 6/1991 | Rhodehouse et al. | 124/44.5 |
| 5,095,884 | 3/1992 | Mertens | 124/44.5 |
| 5,103,797 | 4/1992 | Newbold | 124/44.5 |
| 5,140,972 | 8/1992 | Fisk | 124/44.5 |
| 5,146,908 | 9/1992 | Larson | 124/88 |
| 5,285,764 | 2/1994 | Mertens | 124/44.5 |
| 5,383,441 | 1/1995 | Lightcap | 124/44.5 |
| 5,400,763 | 3/1995 | Mazza | 124/44.5 |

*Primary Examiner*—Eric K. Nicholson
*Assistant Examiner*—John A. Ricci

[57] ABSTRACT

A new and improved overdraw arrow rest device having a bow rest mount adapted for securement to a handle area of the bow. Included in the invention is a rest mount having a first wall and a second wall. The rest mount has a support wall that couples a lower portion of the first wall with a lower portion of the second wall. The first wall is coupled with the bow rest mount. The first wall has a rest shaft aperture formed therethrough. The second wall has a rest shaft aperture formed therethrough aligned with the rest shaft aperture of the first wall. A rest shaft is coupled with the aligning rest shaft apertures of the rest mount. A pair of rest prongs are adjustably secured to the rest shaft by retaining lock screws.

6 Claims, 3 Drawing Sheets

OVERDRAW ARROW REST DEVICE

BACKGROUND OF THE INVENTION

1. Field of the Invention

The present invention relates to an overdraw arrow rest device and more particularly pertains to extending the rest area for a bow with an overdraw arrow rest device.

2. Description of the Prior Art

The use of overdraw extensions is known in the prior art. More specifically, overdraw extensions heretofore devised and utilized for the purpose of supporting an arrow are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,140,972 to Fisk discloses an overdraw extension for compound bows.

U.S. Pat. No. 5,022,378 to Rhodehouse et al. discloses an arrow rest/overdrawn apparatus for an archery bow.

U.S. Pat. No. 5,025,773 to Hintze discloses an archery arrow support.

U.S. Pat. No. 4,829,974 to Anderson discloses an archery arrow and arrow launching device.

U.S. Pat. No. 4,446,844 to Nishioka discloses a projectile shooting guide for bows.

While these devices fulfill their respective, particular objective and requirements, the aforementioned patents do not describe an overdraw arrow rest device for extending the rest area for a bow.

In this respect, the overdraw arrow rest device according to the present invention substantially departs from the conventional concepts and designs of the prior art, and in doing so provides an apparatus primarily developed for the purpose of extending the rest area for a bow.

Therefore, it can be appreciated that there exists a continuing need for new and improved overdraw arrow rest device which can be used for extending the rest area for a bow. In this regard, the present invention substantially fulfills this need.

SUMMARY OF THE INVENTION

In the view of the foregoing disadvantages inherent in the known types of overdraw extensions now present in the prior art, the present invention provides an improved overdraw arrow rest device. As such, the general purpose of the present invention, which will be described subsequently in greater detail, is to provide a new and improved overdraw arrow rest device and method which has all the advantages of the prior art and none of the disadvantages.

To attain this, the present invention essentially comprises a bow rest mount having a front portion and a back portion. The front portion has an oblong aperture therethrough. The oblong aperture aligns with an aperture formed through a handle area of the bow for securement thereto by a bow rest mounting screw. The back portion has a first aperture formed therethrough. The back portion has a pair of guide apertures formed therethrough on either side of the first aperture. The back portion has a height retaining aperture formed therethrough downward of the guide apertures. The device contains a rest mount having a first wall and a second wall. The rest mount has a support wall coupling a lower portion of the first wall with a lower portion of the second wall. The first wall has a first threaded aperture aligning with the first aperture of the bow rest mount and secured thereto by a bolt with an "E" ring retainer. The first wall has a pair of guide apertures formed therethrough on either side of the first aperture. The pair of guide apertures align with the guide apertures of the bow rest mount and are coupled therewith by guide pins. The first wall has a height retaining aperture formed therethrough downward of the guide apertures. The height retaining aperture aligns with the height retaining aperture of the bow rest mount and is coupled therewith by a height retaining pin. The first wall has a rest shaft aperture formed therethrough downward of the height retaining aperture. The first wall has a plurality of spring tension adjustment apertures formed therethrough adjacent the rest shaft aperture. The second wall has a rest shaft aperture formed therethrough aligned with the rest shaft aperture of the first wall. A securement aperture is formed through the second wall rearwardly of the rest shaft aperture thereof. The device contains a rest shaft having a first end, a second end, and an intermediate extent therebetween. The first end extends through the rest shaft aperture of the first wall of the rest mount and is coupled therewith by a retaining lock screw. The second end couples with the rest shaft aperture of the second wall of the rest mount and is secured thereto by a retaining lock screw through the securement aperture formed rearwardly thereof. A tension spring is secured inwardly of the first end by a retaining lock screw. The tension spring is selectively coupled with the plurality of spring tension adjustment holes of the first wall of the rest mount. A pair of rest prongs are adjustably secured to the intermediate extent of the rest shaft by retaining lock screws. The rest prongs are separated therefrom by retaining washers.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved overdraw arrow rest device which has all the advantages of the prior art overdraw extensions and none of the disadvantages.

It is another object of the present invention to provide a new and improved overdraw arrow rest device which may be easily and efficiently manufactured and marketed.

It is a further object of the present invention to provide a new and improved overdraw arrow rest device which is of durable and reliable construction.

An even further object of the present invention is to provide a new and improved overdraw arrow rest device which is susceptible of a low cost of manufacture with regard to both materials and labor, and which accordingly is then susceptible of low prices of sale to the consuming public, thereby making such an overdraw arrow rest device economically available to the buying public.

Still yet another object of the present invention is to provide a new and improved overdraw arrow rest device which provides in the apparatuses and methods of the prior art some of the advantages thereof, while simultaneously overcoming some of the disadvantages normally associated therewith.

Even still another object of the present invention is to provide a new and improved overdraw arrow rest device for extending the rest area for a bow.

Lastly, it is an object of the present invention to provide a new and improved overdraw arrow rest device having a bow rest mount adapted for securement to a handle area of the bow. Included in the invention is a rest mount having a first wall and a second wall. The rest mount has a support wall that couples a lower portion of the first wall with a lower portion of the second wall. The first wall is coupled with the bow rest mount. The first wall has a rest shaft aperture formed therethrough. The second wall has a rest shaft aperture formed therethrough aligned with the rest shaft aperture of the first wall. A rest shaft is coupled with the aligning rest shaft apertures of the rest mount. A pair of rest prongs are adjustably secured to the rest shaft by retaining lock screws.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
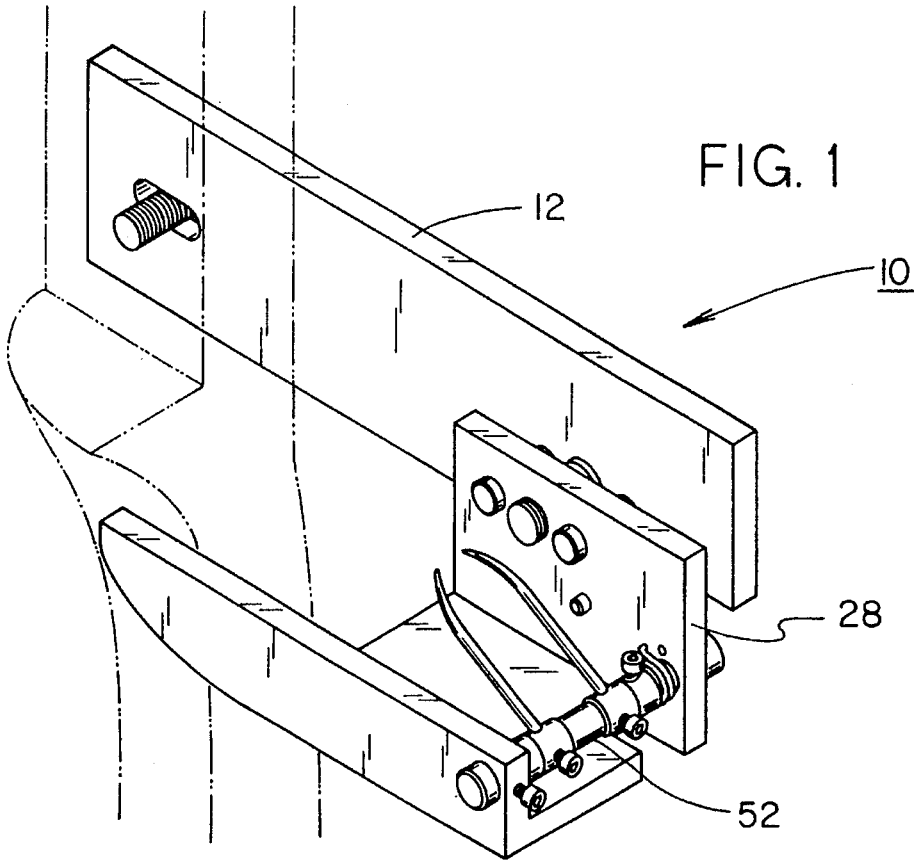
FIG. 1 is a perspective view of the preferred embodiment of the overdraw arrow rest device constructed in accordance with the principles of the present invention.
Figure 2:
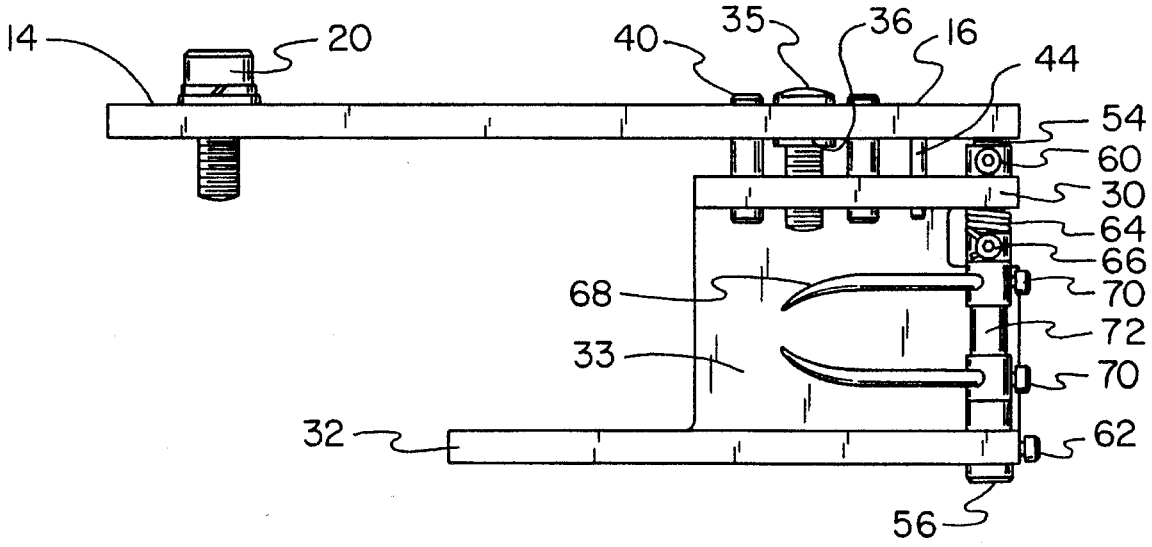
FIG. 2 is a plan elevational view of the present invention.
Figure 3:
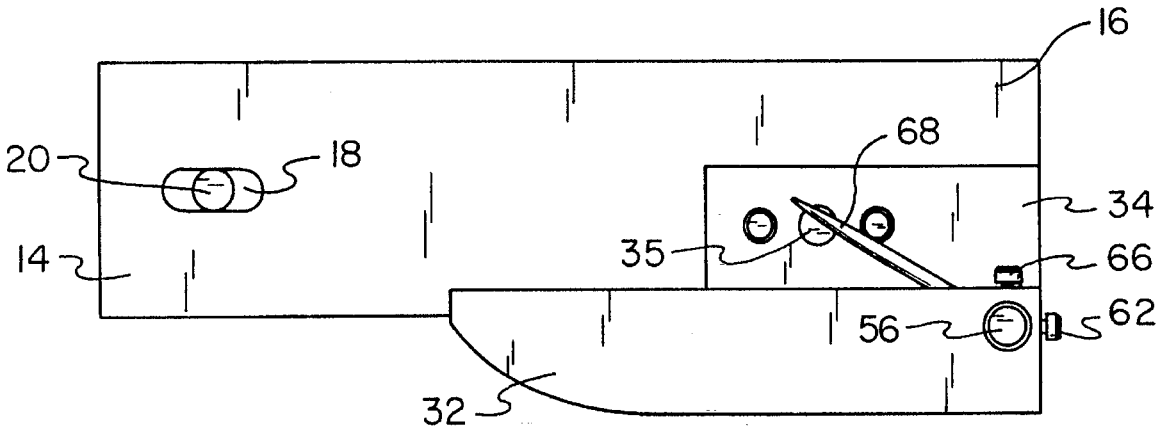
FIG. 3 is a side elevation view of the present invention.
Figure 4:
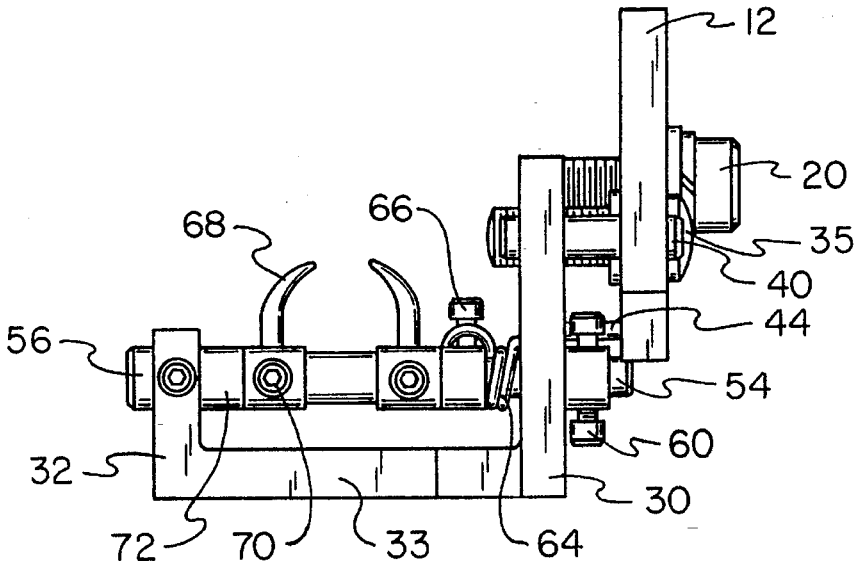
FIG. 4 is a rear elevated view of the present invention.
Figure 5:
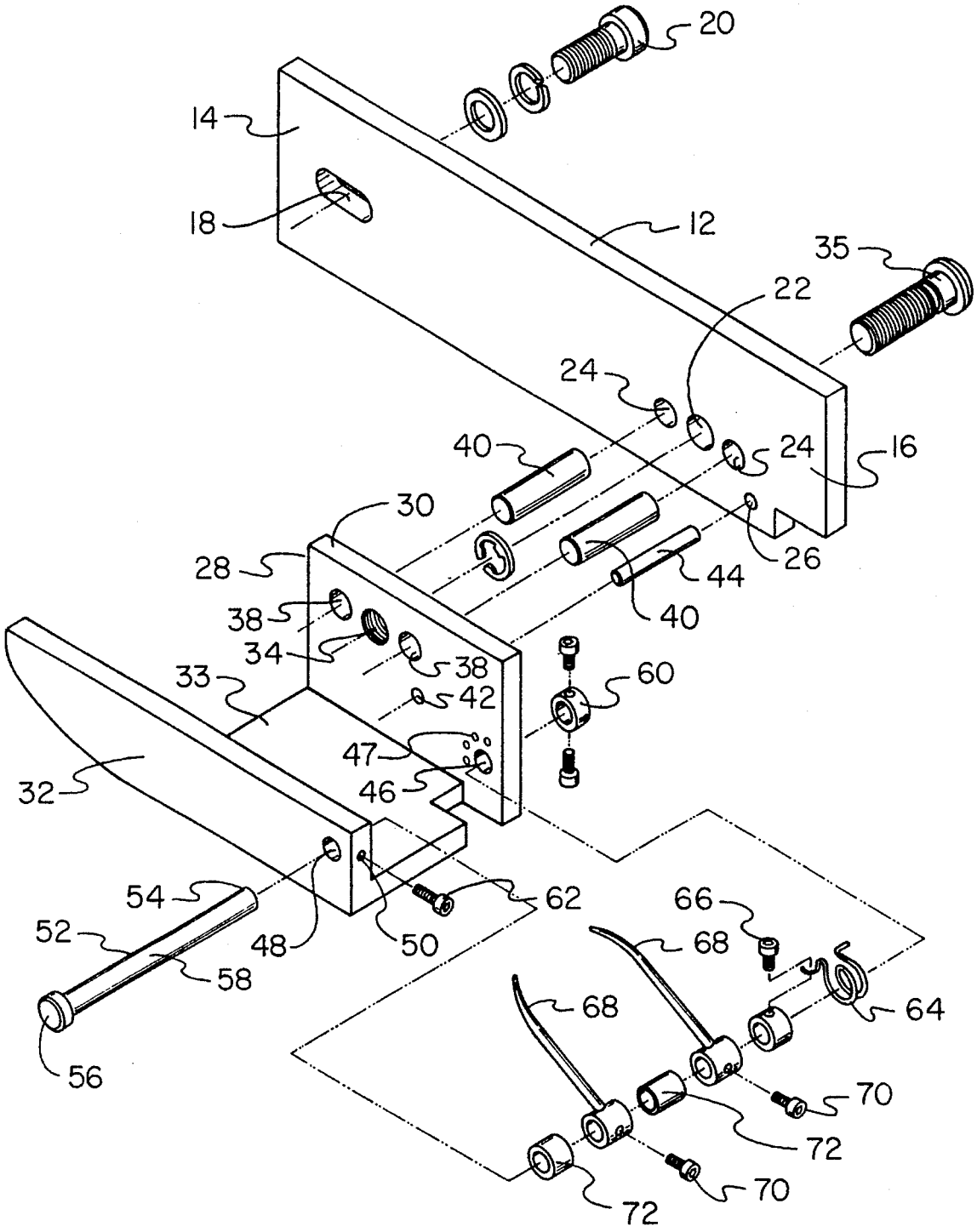
FIG. 5 is an exploded perspective view of the present invention.

With reference now to the drawings, and in particular, to FIG. 1 thereof, the preferred embodiment of the new and improved overdraw arrow rest device embodying the principles and concepts of the present invention and generally designated by the reference number 10 will be described.

Specifically, it will be noted in the various Figures that the device relates to a new and improved overdraw arrow rest device for extending the rest area for a bow. In its broadest context, the device consists of a bow rest mount, a rest mount, and a rest shaft.

The device 10 contains a bow rest mount 12 having a front portion 14 and a back portion 16. The front portion 14 has an oblong aperture 18 therethrough. The oblong aperture 18 aligns with an aperture formed through a handle area of the bow for securement thereto by a bow rest mounting screw 20. The back portion 16 has a first aperture 22 formed therethrough. The back portion 16 has a pair of guide apertures 24 formed therethrough on either side of the first aperture 22. The back portion 16 has a height retaining aperture 26 formed therethrough downward of the guide apertures 24.

The device 10 contains a rest mount 28 having a first wall 30 and a second wall 32. The rest mount 28 has a support wall 33 coupling a lower portion of the first wall 30 with a lower portion of the second wall 32. The support wall 33 provides an extended area for a user to rest their arrow. The first wall 30 has a first threaded aperture 34 aligning with the first aperture 22 of the bow rest mount 12 and secured thereto by a bolt 35 with an "E" ring retainer 36. The first wall 30 has a pair of guide apertures 38 formed therethrough on either side of the first aperture 34. The pair of guide apertures 38 align with the guide apertures 24 of the bow rest mount 12 and are coupled therewith by guide pins 40. The first wall 30 has a height retaining aperture 42 formed therethrough downward of the guide apertures 38. The height retaining aperture 42 aligns with the height retaining aperture 26 of the bow rest mount 12 and is coupled therewith by a height retaining pin 44. The first wall 30 has a rest shaft aperture 46 formed therethrough downward of the height retaining aperture 42. The first wall 30 has a plurality of spring tension adjustment apertures 47 formed therethrough adjacent the rest shaft aperture 46. The second wall 32 has a rest shaft aperture 48 formed therethrough aligned with the rest shaft aperture 46 of the first wall 30. A securement aperture 50 is formed through the second wall 30 rearwardly of the rest shaft aperture 48 thereof.

The device 10 contains a rest shaft 52 having a first end 54, a second end 56, and an intermediate extent 58 therebetween. The first end 54 extends through the rest shaft aperture 46 of the first wall 30 of the rest mount 28 and is coupled therewith by a retaining lock screw 60. The second end 56 couples with the rest shaft aperture 48 of the second wall 32 of the rest mount 28 and is secured thereto by a retaining lock screw 62 through the securement aperture 50 formed rearwardly thereof. A tension spring 64 is secured inwardly of the first end 54 by a retaining lock screw 66. The tension spring 64 is selectively coupled with the plurality of spring tension adjustment apertures 47 of the first wall 30 of the rest mount 28. A pair of rest prongs 68 are adjustably secured to the intermediate extent 58 of the rest shaft 52 by retaining lock screws 70. The rest prongs 68 are separated therefrom by retaining washers 72. The rest prongs 68 can be adjusted up or down depending on the desired positioning the user requires for their arrows.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A new and improved overdraw arrow rest device for extending the rest area for a bow comprising, in combination:

a bow rest mount having a front portion and a back portion, the front portion having an oblong aperture therethrough, the oblong aperture aligning with an aperture formed through a handle area of the bow for securement thereto by a bow rest mounting screw, the back portion having a first aperture formed therethrough, the back portion having a pair of guide apertures formed therethrough on either side of the first aperture, the back portion having a height retaining aperture formed therethrough downward of the guide apertures;

a resting mount having a first wall and a second wall, the resting mount having a support wall coupling a lower portion of the first wall and a lower portion of the second wall, the first wall having a first threaded aperture aligning with the first aperture of the bow rest mount and secured thereto by a bolt with an "E" ring retainer, the first wall having a pair of guide apertures formed therethrough on either side of the first aperture, the pair of guide apertures aligning with the guide apertures of the bow rest mount and coupled therewith by guide pins, the first wall having a height retaining aperture formed therethrough downward of the guide apertures, the height retaining aperture aligning with the height retaining aperture of the bow rest mount and coupled therewith by a height retaining pin, the first wall having a rest shaft aperture formed therethrough downward of the height retaining aperture, the first wall having a plurality of spring tension adjustment apertures formed therethrough adjacent the rest shaft aperture, the second wall having a rest shaft aperture formed therethrough aligning with the rest shaft aperture of the first wall, a securement aperture formed through the second wall rearwardly of the rest shaft aperture thereof;

a rest shaft having a first end, a second end, and an intermediate extent therebetween, the first end extending through the rest shaft aperture of the first wall of the resting mount and coupled therewith by a retaining lock screw, the second end coupled with the rest shaft aperture of the second wall of the resting mount and secured thereto by a retaining lock screw through the securement aperture formed rearwardly thereof, a tension spring secured inwardly of the first end by a retaining lock screw, the tension spring selectively coupled with the plurality of spring tension adjustment apertures of the first wall of the resting mount, a pair of rest prongs adjustably secured to the intermediate extent of the rest shaft by retaining lock screws, the rest prongs separated therefrom by retaining washers.

2. A new and improved overdraw arrow rest device for extending the rest area for a bow comprising, in combination:

a bow rest mount adapted for securement to a handle area of the bow, the bow rest mount having a pair of guide apertures formed therethrough;

a resting mount having a first wall and a second wall, the resting mount having a support wall coupling a lower portion of the first wall and a lower portion of the second wall, the first wall coupled with the bow rest mount, the first wall having a rest shaft aperture formed therethrough, the second wall having a rest shaft aperture formed therethrough aligning with the rest shaft aperture of the first wall, the first wall having a pair of guide apertures formed therethrough aligning with the guide apertures of the bow rest mount and coupled therewith by guide pins;

a rest shaft coupled with the aligning rest shaft apertures of the resting mount, a pair of rest prongs adjustably secured to the rest shaft by retaining lock screws.

3. The device as described in claim 2 wherein the bow rest mount is secured to the handle area of the bow by a bow rest mounting screw.

4. The device as described in claim 3 wherein the resting mount is coupled to the bow rest mount by a bolt with an "E" ring retainer.

5. The device as described in claim 4 wherein a height retaining pin couples the first wall of the resting mount to the bow rest mount.

6. The device as described in claim 5 wherein a tension spring is selectively coupled to the first wall mount and the rest shaft.

* * * * *